US011339972B2

(12) United States Patent
Dinkel et al.

(10) Patent No.: US 11,339,972 B2
(45) Date of Patent: May 24, 2022

(54) DOOR FOR SEALING A COOKING CHAMBER, WHICH HAS A CONDENSATE COLLECTION DEVICE, AND COOKING APPLIANCE

(71) Applicant: BSH Hausgeräte GmbH, Munich (DE)

(72) Inventors: Alexander Dinkel, Unterwoessen (DE); Frederic Dubois, Trostberg (DE); Rainer Maier, Chieming (DE)

(73) Assignee: BSH Hausgeräte GmbH, Munich (DE)

( * ) Notice: Subject to any disclaimer, the term of this patent is extended or adjusted under 35 U.S.C. 154(b) by 742 days.

(21) Appl. No.: 16/088,836

(22) PCT Filed: Mar. 10, 2017

(86) PCT No.: PCT/EP2017/055701

§ 371 (c)(1),
(2) Date: Sep. 27, 2018

(87) PCT Pub. No.: WO2017/174294

PCT Pub. Date: Oct. 12, 2017

(65) Prior Publication Data

US 2020/0300477 A1 Sep. 24, 2020

(30) Foreign Application Priority Data

Apr. 8, 2016 (DE) ..... 10 2016 205923.8

(51) Int. Cl.
*F24C 15/02* (2006.01)
*F24C 15/14* (2006.01)

(52) U.S. Cl.
CPC ..... *F24C 15/022* (2013.01); *F24C 15/021* (2013.01); *E05Y 2900/308* (2013.01); *F24C 15/14* (2013.01)

(58) Field of Classification Search
CPC ..... F24C 15/022; F24C 15/021; F24C 15/14; F24C 15/02; E05Y 2900/308
See application file for complete search history.

(56) References Cited

U.S. PATENT DOCUMENTS 1,585,404 A * 5/1926 Melvin ..... F24C 15/34 126/275 R
1,699,403 A * 1/1929 Moecker, Jr. ..... F24C 15/022 126/190

(Continued)

FOREIGN PATENT DOCUMENTS

CN 101589908 A 12/2009
CN 103080654 A 5/2013

(Continued)

OTHER PUBLICATIONS

Machine translation of DE3820572A1, included as "DE3820572A1_wipo_translate.pdf" (Year: 1989).*

(Continued)

*Primary Examiner* — David J Laux
(74) *Attorney, Agent, or Firm* — Michael E. Tschupp; Andre Pallapies; Brando G. Braum

(57) ABSTRACT

A door for sealing a cooking chamber of a cooking appliance includes a rear wall and a condensate collection device for collecting a condensate draining from a rear side of the rear wall. The condensate collection device includes a collection and guide rail to collect condensate draining from the rear side and to divert the condensate in the direction of a collection container of the condensate collection device.

34 Claims, 4 Drawing Sheets

(56) References Cited

U.S. PATENT DOCUMENTS

| | | | | |
|---|---|---|---|---|
| 2,367,626 | A * | 1/1945 | Shroyer | F24C 15/14 99/425 |
| 3,449,770 | A | 6/1969 | Casebolt | |
| 4,517,886 | A * | 5/1985 | Bales | F24C 15/14 126/41 R |
| 4,641,630 | A | 2/1987 | Meister | |
| 5,447,145 | A | 9/1995 | Cappello et al. | |
| 2009/0178579 | A1* | 7/2009 | Heiser | A47J 37/042 99/421 H |
| 2011/0168154 | A1 | 7/2011 | Ishizaki | |

FOREIGN PATENT DOCUMENTS

| | | | |
|---|---|---|---|
| DE | 3820572 | A1 | 12/1989 |
| DE | 10156419 | A1 | 6/2003 |
| DE | 102004020181 | A1 | 11/2005 |
| DE | 102013216132 | A1 | 3/2014 |
| JP | S55105123 | A | 8/1980 |
| JP | S56140009 | A | 11/1981 |
| JP | 2013076473 | A | 4/2013 |

OTHER PUBLICATIONS

Machine translation of CN103080654A, included as "CN103080654A_wipo_translate.pdf" (Year: 2013).*
National Search Report CN 201780020843.X dated May 21, 2019.
International Search Report PCT/EP2017/055701 dated Mar. 3, 2017.
National Search Report DE 10 2016 205 923.8 dated Feb. 21, 2017.

* cited by examiner

DOOR FOR SEALING A COOKING CHAMBER, WHICH HAS A CONDENSATE COLLECTION DEVICE, AND COOKING APPLIANCE

CROSS-REFERENCES TO RELATED APPLICATIONS

This application is the U.S. National Stage of International Application No. PCT/EP2017/055701, filed Mar. 10, 2017, which designated the United States and has been published as International Publication No. WO 2017/174294 A1 and which claims the priority of German Patent Application, Serial No. 10 2016 205 923.8, filed Apr. 8, 2016, pursuant to 35 U.S.C. 119(a)-(d).

BACKGROUND OF THE INVENTION

The invention relates to a door for sealing a cooking chamber of a cooking appliance. The door comprises a rear wall and a condensate collection device, separated therefrom, which is embodied to collect a condensate draining from a rear side of the rear wall. Furthermore, the invention also comprises a cooking appliance with such a door, which seals a cooking chamber of the cooking appliance.

It known that with cooking appliances, in particular steam cooking appliances, condensate can form on a rear side of a rear wall of a door which faces the cooking chamber. This then runs downward from this rear side. A condensate collection chamber is provided, in order, in this connection, to avoid an unwanted dripping or draining from the rear side into the cooking chamber on the one hand and when the door is open onto the floor or other objects or persons located therebelow on the other hand.

To this end DE 38 20 572 A1 discloses that a channel is arranged in a lower region of the door and is fastened in a fixed manner thereto, in which channel condensate draining from the rear side is firstly collected. The channel is fastened obliquely on the door in a horizontal line so that the condensate collected therein runs in one direction in the channel. With the embodiment there, a collection trough fixed there is in turn fastened to a housing of the steam cooking appliance which is separated from the door. The condensate draining from the door-side channel runs into this. The inclination of the channel is provided so that when the door is opened and there is therefore a relative movement between the channel on the door and the collection trough on the housing, the lower-lying end of the channel nevertheless continues to be located above the collection trough so that even when the door is opened the condensate routed via the channel should still reach the collection trough.

Corresponding embodiments are known from EP 0 170 910 A1 and also from DE 10 2004 020 181 A1. In each case provision is likewise made there for a channel arranged on the door side and a container or a trough arranged externally thereto and on the housing side.

With the embodiments of the condensate collection device known from the prior art, the arrangement between the separated channel on the door and the trough on the housing which is separated therefrom is such that it is not possible to prevent the condensate from running past the channel on the collection trough in all positions of the door. It is probable that the condensate runs past the collection trough specifically when, with an increased age of the cooking appliance or as a result of abutting the channel and/or the trough, a permanent change in position of one of these parts occurs. Furthermore, a misadjustment between the door and the housing automatically causes the misadjustment of the position between the channel on the door and the collection trough on the housing, so that corresponding problems occur with the condensate collection. Furthermore, the drainage of the condensate from the channel into the collection trough is only restricted to one single point, since otherwise, when the door is opened, the drainage from the channel into the collection trough is no longer ensured. As a result, the entire collection process of the condensate is also restricted and limited in terms of position.

BRIEF SUMMARY OF THE INVENTION

It is the object of the present invention to create a door for sealing a cooking chamber of a cooking appliance, in which the collection and delivery into a collection container of a condensate collection device is improved and is adequately fulfilled in all positions of the door. Accordingly a cooking appliance with a door of this type is also to be produced.

This object is achieved by a door and a cooking appliance according to the independent claims.

In one embodiment of an inventive door for sealing a cooking chamber of a cooking appliance, this door is embodied with a rear wall. Furthermore, the door comprises a condensate collection device for collecting condensate draining from a rear side of the rear wall. The condensate collection device comprises in particular a collection and guide rail arranged on the door. The condensate draining from the rear side can be caught by this collection and guide rail. The condensate can be diverted in the direction of a collection container of the condensate collection device arranged on the door and in particular available.

With an inventive preferred embodiment, provision is then made for this condensate collection device to comprise the collection and guide rail and also the collection container and for both the collection and guide rail and also the collection container to be arranged on the door side.

There is thus provision for all components which guide the condensate from the rear side of the rear wall as far as the final collection point to be arranged on the door itself. As a result, with each possible door position there is provision for a movement of both the collection and guide rail and also the collection container, and these two components therefore achieve the same movement as the door itself. There is therefore in particular also no relative movement between the collection and guide rail and the collection container if the door moves. As a result, the condensate can be delivered from the rear side of the rear wall as far as the collection container in an improved manner and in each position of the door it can be enabled in the same way. As a result, the targeted delivery of the condensate as far as the collection container is also permanently enabled. By means of this embodiment, it is then also possible for the door to be provided both as a door hinged on the left side and also on the right side of a housing of the cooking appliance, without, in the process, the position of the collection and guide rail and/or the collection container having to be changed and adjusted. As a result, considerable assembly effort is saved. The number of identical parts for use with respect to different variants of doors hinged on different sides is also increased as a result. For both variants of the doors, which can therefore be hinged differently, the same components of the condensate collection device can therefore be used.

In particular, provision is made for the collection and guide rail to be arranged in a fixed manner on the door. Provision is in particular also made for the collection container to be arranged in a fixed manner on the door.

The collection container is preferably embodied as an elongated channel. As a result, the condensate can run from the collection and guide rail into the collection container from above in a very simple manner. Unwanted running past is then also avoided if a larger quantity of condensate accumulates and is guided by way of the collection and guide rail. In particular, the collection container extends at least across the same length dimensions as the collection and guide rail. As a result collection of the entire condensate is also improved and the probability that condensate would run past the collection container when draining from the collection and guide rail is reduced, in particular prevented.

In one advantageous embodiment, provision is made for the collection and guide rail to be arranged in the region of a lower edge of the rear wall. The collection and guide rail comprises a trap sheet, which extends obliquely upward and is inclined rearward facing away from the rear side. By means of this embodiment, a type of inlet, in particular partially funnel-type embodiment, is produced by the trap sheet which is separated from the rear wall, thereby preventing the condensate from running past the collection and guide rail when running down the rear side. In particular, an angle between 10° and 80°, in particular between 20° and 70°, in particular between 20° and 50° is formed between the plane of the rear side and a plane in which the trap sheet extends.

Even in situations in which a great deal of condensate runs downward on the rear side and thus toward the lower edge of the rear wall, this embodiment with the trap sheet prevents condensate from then spreading elsewhere and not being guided through the collection and guide rail into the collection container. On account of the geometry of the trap sheet and its arrangement toward the rear wall, a groove-type intermediate storage area or an intermediate storage volume for this condensate is therefore also produced so that even with a minimal accumulation of the condensate, the passage through a constriction between the lower edge of the rear wall and the collection and guide rail still allows the condensate to be diverted entirely from the collection and guide rail to the collection container.

In particular, provision is made for the trap sheet to be embodied in two layers at least in regions. In this way it is reinforced per se and already on account of this embodiment is also permanently inherently stable, even if it has been subjected to strong temperature fluctuations, for instance, as may be the case during operation of the cooking appliance on the one hand, in the non-switched-on state of the cooking appliance on the other hand. In particular if the cooking appliance is also embodied for pyrolysis operation, temperatures of more than 500° C. may occur, which can then also have an effect on the trap sheet. Furthermore, an increased mechanical stability is also achieved on account of this double-layered embodiment, at least in regions, of the trap sheet, so that no unwanted permanent deformation occurs with an abutting or similar thereon, for instance.

Provision is in particular made for these double layers to be embodied by means of a fold. In particular, the trap sheet is therefore designed with a double layer on its free end by means of an upper bend.

In an advantageous embodiment, provision is made for the collection and guide rail to be embodied in one piece. As a result, the number of components is reduced and simple manufacture is enabled. As a result, the assembly effort is also reduced. In particular, the one-piece design is achieved in that the collection and guide rail is produced from a single-piece blank and is manufactured in particular as a bent component.

Provision can be made for the collection and guide rail to be embodied from a metal. It can be embodied in particular from spring steel or stainless steel.

With an advantageous embodiment, provision is made for the collection and guide rail to be arranged in the region of a lower edge of the rear wall and for a guide strip of the collection and guide rail to extend below a lower edge of the rear wall and at a distance from this lower edge. In the depth direction of the door, this guide strip extends beyond the thickness of the rear wall on both sides. Furthermore, the guide strip is arranged inclined obliquely downward, wherein at least one drip edge of the guide strip, from which the routed condensate drains into the collection container, is arranged lower in the height direction of the door than an edge of this guide strip facing the drip edge. On account of this defined oblique position, rotation about a longitudinal axis of the guide strip, or inclined orientation of the guide strip downward, its positional arrangement and geometric extension beyond the thickness dimensions of the rear wall, all condensate will be caught or received from the rear side by the collection and guide rail and will be forwarded to the collection container in a very targeted manner via the shortest route. This oblique position of the guide strip is observed in particular in the sectional view in a plane which is oriented at right angles to the longitudinal axis of the collection and guide rail.

The collection and guide rail is arranged, viewed in the direction of its longitudinal axis, without an inclination and therefore horizontally. In the advantageous embodiment of the invention the condensate is not drained from the collection and guide rail in the direction of the longitudinal axis of the collection and guide rail, but instead transversely thereto. This is a further very advantageous embodiment, since a drainage into the collection container via the shortest route is possible at several points or across the entire length of the collection and guide rail and not only at one end of this collection and guide rail, viewed in the longitudinal direction, as is the case in the prior art.

As a result, a more uniform and, with respect to the quantity, more extensive receiving and diverting of condensate is also enabled. This embodiment is also possible if and only if the collection container and the collection and guide rail are both arranged on the door, and are arranged without relative movement with respect to one another, irrespective of how the door is moved and in which position it is currently located.

In one advantageous embodiment, provision is made for the cited trap sheet to lead onto the edge of the guide strip and for the trap sheet and the guide strip to be arranged at an angle from one another. This means that both the trap sheet extends in a plane, and also the guide strip extends in a separate plane and these two planes are not parallel or congruent with one another, but are instead arranged at an angle, preferably between 90° and 160°, in particular between 100° and 130°. This angle specification is also visible in a plane which is oriented at right angles to the longitudinal extension of the collection container and also vertically to the longitudinal extension or at right angles to the longitudinal axis of the collection and guide rail.

In an advantageous embodiment, provision is made for the condensate collection device to have a carrier, with which the condensate collection device is fastened to the door. In particular, there is provision for an attachment on a holder of the door, which is embodied to hold at least the rear wall. As a result, a mechanically stable connection to the door is achieved, so that the permanent positionally secure attachment is also achieved. By means of an additional carrier of this type, it is then also not necessary for the collection and guide rail itself to have to be provided accordingly with holding elements or suchlike and therefore also not to be unnecessarily large and bulky.

Provision is made in particular for the collection and guide rail to be a component which is separated from the carrier and connected to the carrier. As a result, the two parts can then be separated and cleaned individually. Individual replacement is then also possible without the entire component having to be removed.

In an advantageous embodiment, provision is made for the collection and guide rail to be embodied in one piece with the carrier. As a result, positional tolerances with respect to one another can be avoided, assembly effort can be reduced and the number of components minimized.

In an advantageous embodiment, provision is made for the collection and guide rail and the carrier to be formed as a bent component made from a single-piece blank. In particular, an embodiment made from spring steel or stainless steel is also advantageous here.

In a preferred embodiment, provision is made for a connection to be established between the collection and guide rail and the carrier, viewed over a length of the connection, at several points, and clearances with drip edges of the collection and guide rail for draining the guided condensate into the collection container are formed between these points. In an advantageous embodiment, a connecting line or a connecting edge is therefore in effect produced, which is therefore formed to be perforated to a certain degree and thus alternately and alternatively a connecting point or a point and then in turn a clearance are formed. As a result, a multifunctionality is reached precisely at this transition region between the collection and guide rail and the carrier, by namely on the one hand the mechanical connection between these components being produced, but on the other hand the draining off of the condensate from the collection and guide rail into the collection container also being enabled, in particular at several positions. As a result, there is a possibility, in the longitudinal direction of the collection and guide rail, of being able to allow condensate to run into the collection container at several separated points.

In a further advantageous embodiment, provision is made for the support to have a receiving region for receiving the collection container. Provision is then preferably made in this embodiment for the carrier and the collection container to be two separate components. By means of this embodiment, the collection container can then be reversibly separated from the carrier in a non-destructive manner and then refastened again. As a result, the collection container can be handled individually, for instance for cleaning purposes.

Provision is advantageously made for the receiving region then to have spring lugs, by means of which the collection container can be latched into the receiving region. As a result, the receiving region can be deformed in effect elastically, and the assembly and disassembly of the collection container is possible easily and quickly, wherein a positionally secure accommodation of the collection container is still achieved. A snap-fit is also understood in the light of this latching, so that the collection container can be latched or snap-fitted in the receiving region by a simple insertion and/or pivot movement about its longitudinal axis and a specific clamping effect is then also generated by means of the elastic spring lugs.

The receiving region preferably has a pocket on its upper boundary, in which the collection container immerses with a channel wall top side and is then held thereon.

Provision can also be made, however, for the collection container to be embodied in one piece with the carrier, in particular molded as a bent component from one blank.

The possible embodiments of the invention therefore also allow the carrier, the collection container and the collection and guide rail to be manufactured and provided as a single-piece component. Provision can also be made, however, for pairs of these three elements to be embodied in one piece and for the respective third component or the respective third element then to be separate. In a further embodiment, it is also possible, however, for all three cited components to be separate components per se. There may be more separate components.

In an advantageous embodiment, provision is made for the carrier of the condensate collection device to be embodied in regions with two abutting panel parts. As a result, the carrier is designed to be reinforced and more stable. In particular, provision is made for the collection and guide rail to lead onto a panel part and for a receiving region for receiving the collection container to lead onto the other panel part. In this connection provision is preferably made for the carrier to be embodied in one piece and for the two panel parts to be formed by bending so as to rest against one another and thus extend parallel to one another. The collection and guide rail then preferably leads onto a free end of the first panel part which opposes the bend between these panel parts, and the receiving region leads onto a free end of the second panel part which opposes the bend.

Furthermore, the invention also relates to a cooking appliance and thus a domestic appliance for preparing food. The cooking appliance comprises a housing, in which a cooking chamber is embodied for preparing the food. The cooking appliance furthermore also then comprises a door according to the invention or an advantageous embodiment thereof, which is arranged pivotably on the housing. In this connection the door is arranged as a rotary door. The door can be pivoted in particular about a vertical axis. In this connection the door can be hinged to the left or right on the housing and pivoted relative thereto. The door can, however, also be embodied so as to be displaceable horizontally in the depth direction of the cooking appliance, as is the case for instance with a sliding oven door.

The stipulations "above", "below", "in front", "behind", "horizontal", "vertical", "depth direction", "width direction", "height direction", etc. indicate positions and orientations during proper use and arrangement of the container and with an observer positioned in front of, and looking in the direction of, the container.

Further features of the invention emerge from the claims, the figures and the description of the figures. The features and combinations of features mentioned in the description above and the following features and combinations of features in the description of the figures and/or shown in the figures alone are usable not only in the respective combination given, but also in other combinations without departing from the scope of the invention. Embodiments of the invention which are not explicitly shown in the figures and described, but which arise and can be created through separate combinations of features from the embodiments described are therefore also to be considered as included and disclosed. Embodiments and combinations of features that thus do not have all features of an originally worded independent claim are also to be regarded as disclosed. In addition, embodiments and combinations of features, in particular thanks to the embodiments set forth above, that go further than or deviate from the combinations of features set forth in the related claims are also to be regarded as disclosed.

BRIEF DESCRIPTION OF THE DRAWINGS

Exemplary embodiments of the invention will now be described in greater detail making reference to schematic drawings, which show.

DETAILED DESCRIPTION OF EXEMPLARY EMBODIMENTS OF THE PRESENT INVENTION

Figure 1:
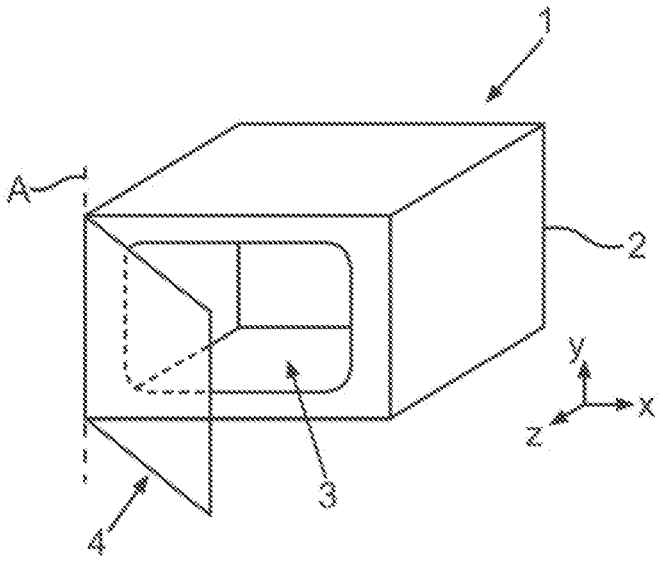
FIG. 1 a schematic perspective representation of an exemplary embodiment of an inventive cooking appliance.

In the drawings, the same or functionally identical elements are provided with the same reference characters.

FIG. 1 shows a simplified representation of a cooking appliance 1, which may be a steam cooking appliance, for instance. The cooking appliance 1 comprises a housing 2 in which a cooking chamber 3 is embodied. The cooking chamber 3 is accessible at the front through a loading opening, which can be sealed by a door 4. The door 4 can be rotated about a vertical axis of rotation A which is thus oriented in the height direction (y-direction). The door 4 is therefore a rotary door, which is pivotably hinged to the left on the housing 2 in the exemplary embodiment shown.

Figure 2:
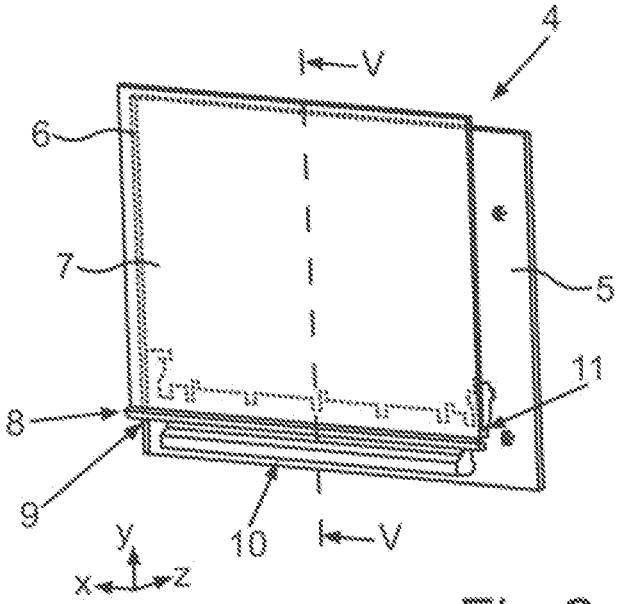
FIG. 2 a perspective view of components of a door of the cooking appliance according to FIG. 1.

In the exemplary embodiment, the door 4 has at least two separate panel parts, which, according to the perspective representation in FIG. 2, represent an outer panel or a front panel 5 and an inner panel or rear wall 6 separated therefrom. The front panel 5 and the rear wall 6 embodied as an inner panel are preferably embodied parallel to one another or slightly inclined to one another and are preferably glass panels.

A perspective view onto a rear side 7 of the rear wall 6 is shown in FIG. 2, wherein, in the closed state of the door 4, this rear side 7 is facing the cooking chamber 3, or generally facing away from the front panel 5.

In particular during operation of the cooking appliance 1 and thus when the door 4 is closed, condensate can form on the rear side 7, which then runs downward on the rear side 7 under gravitational force. In order to catch and collect this condensate, the door 4 comprises a condensate collection device 8. The condensate collection device 8 in turn has a collection and guide rail 9 and a collection container 10. The collection and guide rail 9 and also the collection container 10 are arranged in a fixed manner on the door 4, in particular on the rear wall 6. The collection and guide rail 9 and also the collection container 10 are preferably arranged in a fixed position relative to one another, irrespective of how the door 4 is moved or which position it has currently assumed. The collection is preferably carried out once the door 4 is moved out of its completely closed position and is thus opened. In particular, provision is made in one embodiment for the condensate to run back into the cooking chamber when the door 4 is completely closed, particularly on account of the embodiment of a seal between the door and a cooking chamber flange.

As is apparent, the collection and guide rail 9 preferably extends across the entire width of the rear wall 6 and thus in the width direction and thus in the z-direction across the entire width dimension of the rear wall 6, in particular in a lower region 11.

Figure 3:
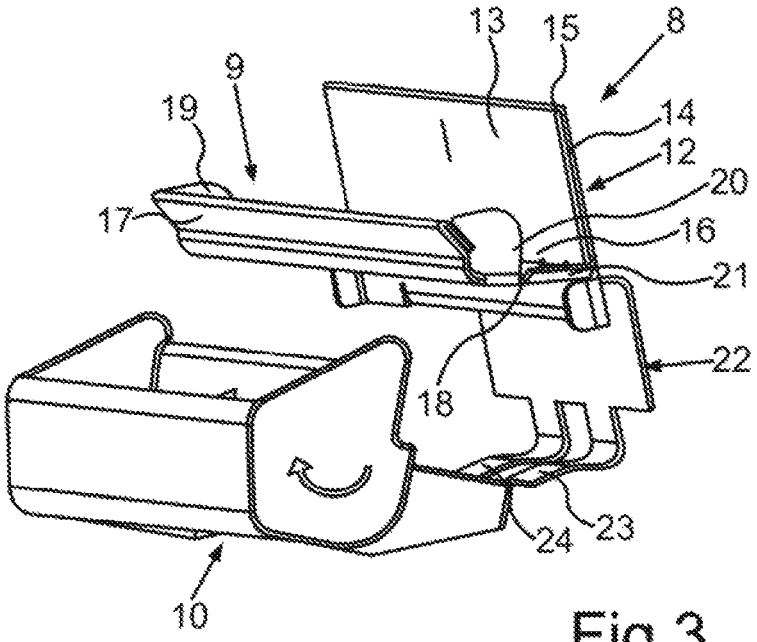
FIG. 3 a perspective representation of an exemplary embodiment of components of a condensate collection device, as installed in the cooking appliance according to FIG. 1.

FIG. 3 shows a perspective representation of the condensate collection device 8 in one exemplary embodiment. Provision is made in this embodiment for the collection and guide rail 9 to be embodied in one piece with the carrier 12. The carrier 12 and the collection and guide rail 9 are embodied in one piece here and are in particular molded correspondingly by means of bending from a blank made of spring steel or stainless steel. A bent component is thus embodied here. With this embodiment, the collection container 10 is designed as a separate component and produced from plastic, for instance.

As is apparent, the carrier 12 comprises a first panel part 13 and a second panel part 14 resting thereon and extending in parallel thereto. The panel parts 13 and 14 are connected by means of an upper bend 15. The collection and guide rail 9 leads onto a free edge 16 of the first panel part 13, which opposes the upper bend 15. The collection and guide rail 9 comprises a trap sheet 17 and a guide strip 18. The trap sheet 17 extends in a plane, which is arranged at an angle from the plate-shaped guide strip 18. The angle preferably amounts to between 100° and 130°. As apparent in the representation in FIG. 3, the trap sheet 17 is embodied at least in regions with a double layer across its planar dimensions, wherein here in particular the double layers are achieved by means of a fold. Cover flaps 19 and 20 connect to the trap sheet 17 in the longitudinal direction (x-direction in FIG. 2) on opposite ends, wherein these flaps 19 and 20 are molded on opposing edges of the guide strip 18 and are bent upward by means of bending.

Furthermore, uparchings 21 are embodied on opposing edges in the longitudinal direction of the guide strip 18, which extends in the width direction and thus in the x-direction. As a result, an unwanted draining of the condensate which occurs laterally or in the direction of the longitudinal axis of the collection and guide rail 9 is avoided.

Furthermore, it is apparent in FIG. 3 that a receiving region 22 for receiving the collection container 10 also leads onto the carrier 12, in particular onto the free end of the panel part 14 which opposes the upper bend 15. The receiving region 22 can be deformed elastically and to this end has in particular one, in the exemplary embodiment two, spring elements or spring lugs 23 and 24. The collection container 10 can be latched or snap-fitted into this receiving region 22, and by means of the elastic spring lugs 23 and 24 the clamping effect is then achieved. Provision can also be made for the lugs to be rigid and the collection container 10 to be elastically deformable.

As is apparent, the collection container 10 is embodied in the manner of a channel or trough. It is likewise produced preferably in one piece.

As is apparent, the guide strip 18 leads obliquely onto the first panel part 13, wherein an angle between the plane, in which the first panel part 13 extends, and a plane in which the guide strip 18 extends, is smaller than 90°.

Figure 4:
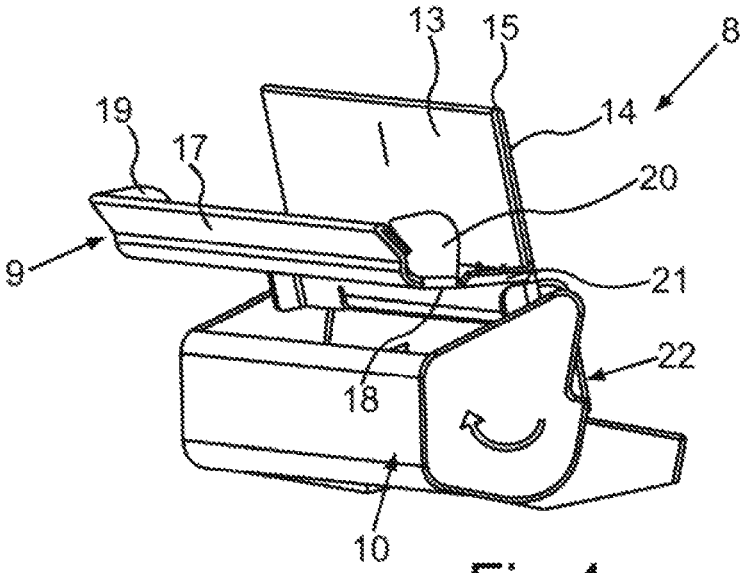
FIG. 4 the representation of components according to FIG. 3 in the assembled state.

FIG. 4 shows the assembled state between the single-piece component comprising the collection and guide rail 9 and the carrier 12 with the collection container 10.

Figure 5:
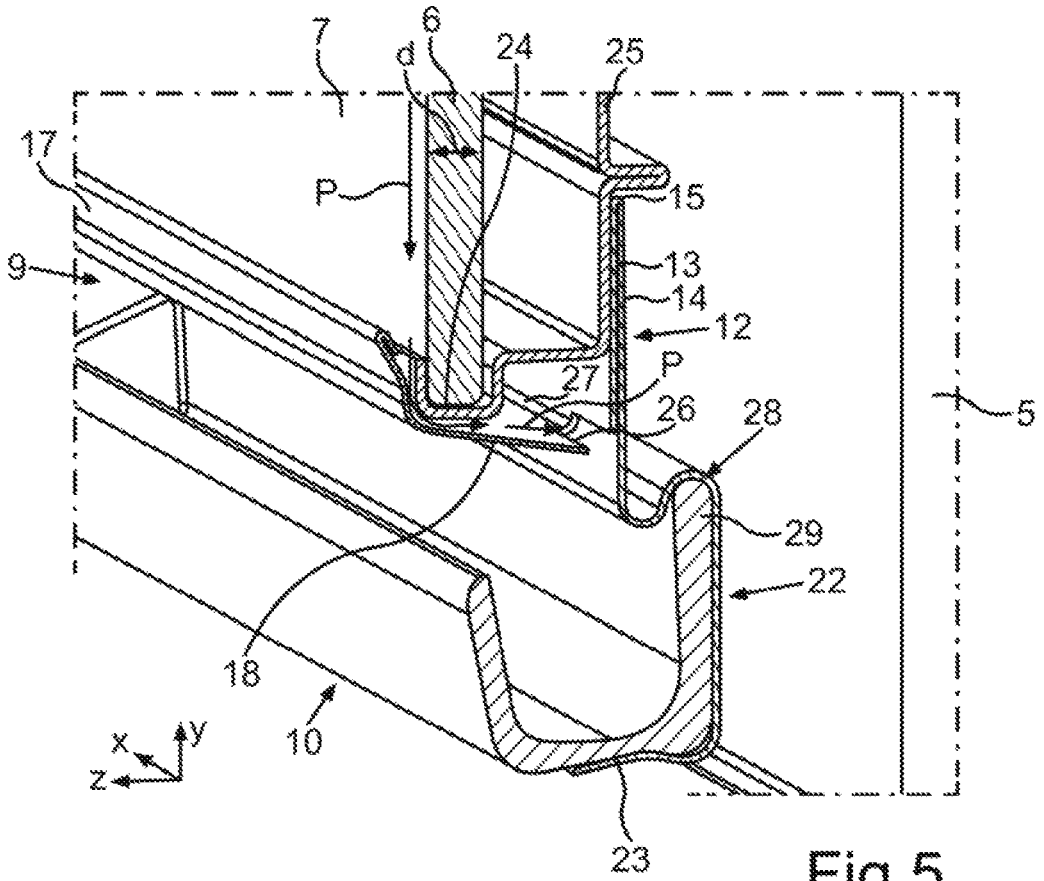
FIG. 5 a perspective cross-sectional representation of the embodiment according to FIG. 2.

FIG. 5 shows an enlarged representation of a subarea of the arrangement of the elements according to FIG. 2 along the line of intersection V-V. As is apparent here, the collection and guide rail 9 is arranged in the lower region 11, but at a distance therefrom. In particular in the height direction and thus in the y-direction, the guide strip 18 is distanced downward from a lower edge 24 of the rear wall 6. In the depth direction and thus in the z-direction, the guide strip 18 is however dimensioned such that it extends on both sides of the rear wall 6 and therefore has larger dimensions than a thickness d of the rear wall 6. Furthermore, it is also apparent that the trap sheet 17 at an angle from the plane of the rear side 7 extends downward or is arranged at an angle thereto such that a funnel-type inlet is formed between the rear side 7 and the trap sheet 17. The groove shape of the inlet makes it possible for the condensate on the rear side 7 not to run unintentionally past the collection and guide strip 9. As is apparent, an angle between the trap sheet 17 and the rear side 7 in a y-z plane is preferably less than 60°, in particular between 20° and 45°.

By means of the arrows, the route of the condensate P from the rear side 7 into the collection container 10 is indicated by way of example. It is apparent here that the condensate P runs downward via the rear side 7 and in the exemplary embodiment runs past a holder 25 on the outside, which surrounds the lower edge 24 with a preferably U-shaped rail, and thus passes through between this holder 25 and the collection and guide rail 9. On the top side of the guide strip 18, which is oblique compared with a horizontal plane, the condensate P then runs as far as a drip edge 26 of the guide strip 18 and then drips or runs into the collection tray or the collection container 10 arranged therebelow. As is apparent, the carrier 12 is fastened to the holder 25. In particular, provision is made here for the first panel part 13 to be fastened thereon. The holder 25 is provided and embodied in particular to hold at least the rear wall 6.

A connection 27 between the collection and guide rail 9 and the carrier 12 is not embodied across this entire length in the direction of the longitudinal axis, which extends in the x-direction, but only in regions in this regard. A number of connecting points which are arranged separated and at a distance from one another are preferably embodied in this connection. Clearances are then produced between these connecting points, through which the condensate P can run and can extend into the collection container 10. Individual drip edges 26 are then formed on the guide strip 18 in these clearances. As is apparent in FIG. 5, one end which leads onto the trap sheet 17 in the height direction and thus in the y direction or one edge of the guide strip 18 which leads thereto is therefore arranged higher than an edge which has the at least one drip edge 26 and which faces away from this trap sheet 17.

It is also apparent in FIG. 5 how the receiving region 22 is embodied in its region facing the carrier 12. A pocket 28 is formed here, in which a channel wall 29 of the collection container 10 engages or undercuts. This pocket 28 is embodied by a preferably S-shaped mold, so that on the one hand the positionally secure arrangement of the collection container 10 is achieved and a slipping in at least two spatial directions is thus prevented. The upper end of the channel wall 29 is thus pressed into this pocket 28 by the upwardly acting spring force of the spring lugs 23 and 24.

Figure 6:
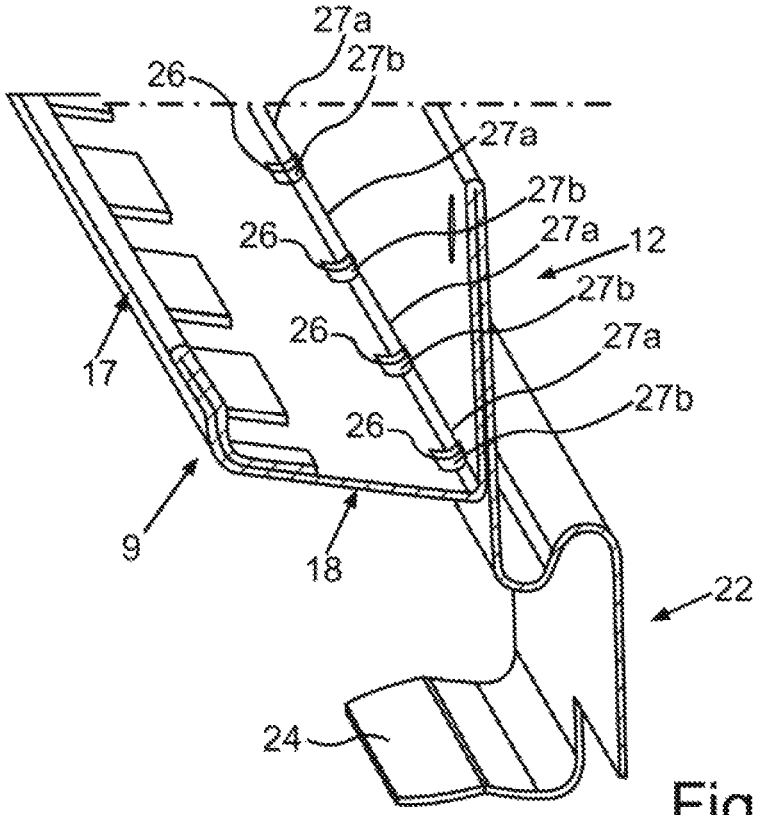
FIG. 6 a perspective partial representation of an exemplary embodiment of a collection and guide rail and of a carrier of the condensate collection device.

FIG. 6 shows a perspective representation of a subregion of a single-piece embodiment of a component with the collection and guide rail 9, the carrier 12 and the receiving region 22. It is apparent here that a number of connecting points 27*a* are embodied and clearances 27*b* are designed therebetween in each case, so that as a result the condensate P can run or drip from the guide strip 18 and can reach the collection container 10. In this embodiment, only the spring lug 24 is shown.

Figure 7:
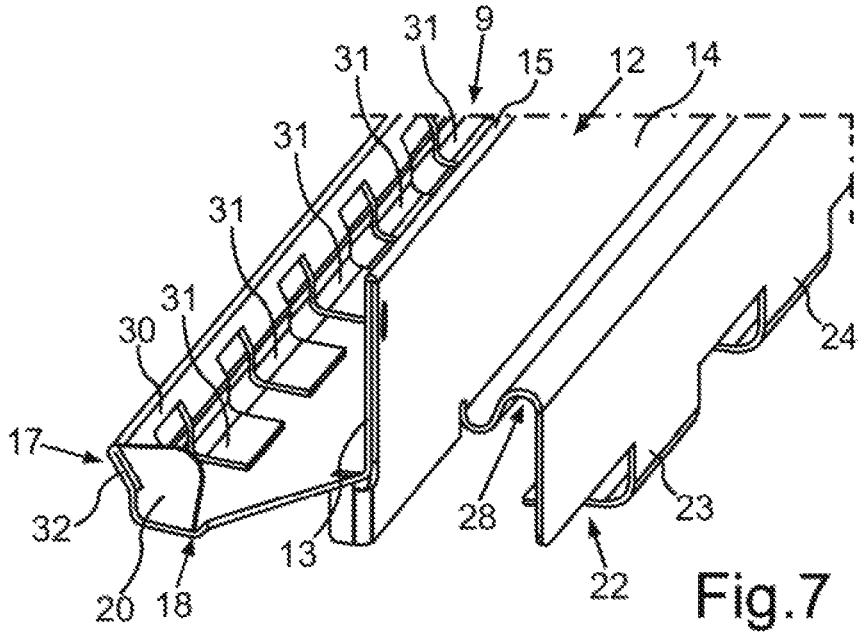
FIG. 7 the component representation according to FIG. 6 in a perspective which differs therefrom.

FIG. 7 shows a perspective view of the cited single-piece component which differs from FIG. 6. The double layers of the trap sheet 17 are shown here, wherein here corresponding lugs are molded on a fold web 30, which forms the second position, wherein these lugs 31 preferably rest in a form-fit manner on the first layer 32 of the trap sheet 17, and are thus molded accordingly, on the other hand they also rest on the guide strip 18. This achieves a particularly high form stability of the collection and guide strip 9.

The invention claimed is:

1. A door for sealing a cooking chamber of a cooking appliance, said door comprising:

a rear wall;

a condensate collection device configured to collect a condensate draining from a rear side of the rear wall, said condensate collection device comprising a collection container which is arranged on the door, and a collection and guide rail which is arranged on the door and which collects the condensate draining from the rear side and diverts the condensate in a direction of the collection container of the condensate collection device;

a carrier to fasten the condensate collection device to the door; and a connection between the collection and guide rail and the carrier, said connection, as viewed across a length of the connection, including several connecting points, with clearances with drip edges of the collection and guide rail being formed between the connecting points for draining off the condensate into the collection container.

2. The door of claim 1, wherein the collection and guide rail is arranged in a region of a lower edge of the rear wall and includes a trap sheet which extends obliquely upward and at an incline facing away from the rear side.

3. The door of claim 2, wherein the trap sheet has at least one region in which the trap sheet is embodied in double layers at least in regions.

4. The door of claim 3, wherein the trap sheet has a fold for forming the double layers.

5. The door of claim 1, wherein the collection and guide rail is arranged in a region of a lower edge of the rear wall and includes a guide strip which extends below a lower edge and at a distance from the lower edge and which extends in a depth direction of the door beyond a thickness of the rear wall on both sides and is arranged obliquely downward, said guide strip having a drip edge, from which condensate drains into the collection container and which is arranged lower in a height direction of the door than an edge of the guide strip in opposition to the drip edge.

6. The door of claim 5, wherein the collection and guide rail is arranged in a region of a lower edge of the rear wall and includes a trap sheet which extends obliquely upward and at an incline facing away from the rear side, said trap sheet leading onto an edge of the guide strip, with the trap sheet and the guide strip being arranged at an angle from one another.

7. The door of claim 1, further comprising a holder configured to hold the rear wall, said carrier being fastenend to the holder.

8. The door of claim 1, wherein the collection and guide rail is a component which is separate from the carrier and is connected to the carrier.

9. The door of claim 1, wherein the collection and guide rail is embodied in one piece with the carrier.

10. The door of claim 9, wherein the collection and guide rail and the carrier are molded as a bent component made from a single-piece blank.

11. The door of claim 1, wherein the carrier has a receiving region for receiving the collection container.

12. The door of claim 11, wherein the receiving region has spring lugs capable of latching the collection container into the receiving region.

13. The door of claim 1, wherein the collection container is embodied in one piece with the carrier.

14. The door of claim 13, wherein the collection container and the carrier are formed as a bent component from a blank.

15. The door of claim 1, wherein the carrier has at least one region with two abutting panel parts, with the collection and guide rail leading onto one of the panel parts and with a receiving region for receiving the collection container leading onto the other one of the panel parts.

16. A cooking appliance, comprising:

a housing having a cooking chamber embodied therein;

a door configured to seal the cooking chamber and capable of pivoting about a vertical axis relative to the housing, said door comprising a rear wall, and a condensate collection device configured to collect a condensate draining from a rear side of the rear wall, said condensate collection device comprising a collection container which is arranged on the door, and a collection and guide rail which is arranged on the door and which collects the condensate draining from the rear side and diverts the condensate in a direction of the collection container of the condensate collection device;

a carrier to fasten the condensate collection device to the door; and a connection between the collection and guide rail and the carrier, said connection, as viewed across a length of the connection, including several connecting points, with clearances with drip edges of the collection and guide rail being formed between the connecting points for draining off the condensate into the collection container.

17. The cooking appliance of claim 16, wherein the collection and guide rail is arranged in a region of a lower edge of the rear wall and includes a trap sheet which extends obliquely upward and at an incline facing away from the rear side.

18. The cooking appliance of claim 17, wherein the trap sheet has at least one region in which the trap sheet is embodied in double layers at least in regions.

19. The cooking appliance of claim 18, wherein the trap sheet has a fold for forming the double layers.

20. The cooking appliance of claim 16, wherein the collection and guide rail is arranged in a region of a lower edge of the rear wall and includes a guide strip which extends below a lower edge and at a distance from the lower edge and which extends in a depth direction of the door beyond a thickness of the rear wall on both sides and is arranged obliquely downward, said guide strip having a drip edge, from which condensate drains into the collection container and which is arranged lower in a height direction of the door than an edge of the guide strip in opposition to the drip edge.

21. The cooking appliance of claim 20, wherein the collection and guide rail is arranged in a region of a lower edge of the rear wall and includes a trap sheet which extends obliquely upward and at an incline facing away from the rear side, said trap sheet leading onto an edge of the guide strip, with the trap sheet and the guide strip being arranged at an angle from one another.

22. The cooking appliance of claim 16, further comprising a holder configured to hold the rear wall, said carrier being fastenend to the holder.

23. The cooking appliance of claim 16, wherein the collection and guide rail is a component which is separate from the carrier and is connected to the carrier.

24. The cooking appliance of claim 16, wherein the collection and guide rail is embodied in one piece with the carrier.

25. The cooking appliance of claim 24, wherein the collection and guide rail and the carrier are molded as a bent component made from a single-piece blank.

26. The cooking appliance of claim 16, wherein the carrier has a receiving region for receiving the collection container.

27. The cooking appliance of claim 26, wherein the receiving region has spring lugs capable of latching the collection container into the receiving region.

28. The cooking appliance of claim 16, wherein the collection container is embodied in one piece with the carrier.

29. The cooking appliance of claim 28, wherein the collection container and the carrier are formed as a bent component from a blank.

30. The cooking appliance of claim 16, wherein the carrier has at least one region with two abutting panel parts, with the collection and guide rail leading onto one of the panel parts and with a receiving region for receiving the collection container leading onto the other one of the panel parts.

31. A door for sealing a cooking chamber of a cooking appliance, said door comprising:

a rear wall;

a condensate collection device configured to collect a condensate draining from a rear side of the rear wall, said condensate collection device comprising a collection container which is arranged on the door, and a collection and guide rail which is arranged on the door and which collects the condensate draining from the rear side and diverts the condensate in a direction of the collection container of the condensate collection device;

a carrier to fasten the condensate collection device to the door; and a connection between the collection and guide rail and the carrier, said connection, as viewed across a length of the connection, including a plurality of drainage openings for draining off the condensate into the collection container.

32. The door of claim 31, wherein the carrier has a receiving region for receiving the collection container.

33. The door of claim 31, wherein the receiving region has spring lugs capable of latching the collection container into the receiving region.

34. The door of claim 31, wherein the rear wall has a front side opposite to the rear side, and the plurality of drainage openings are located closer to the front side than they are to the rear side.

* * * * *